US005080155A

United States Patent [19]

Crozier

[11] Patent Number: 5,080,155

[45] Date of Patent: Jan. 14, 1992

[54] KEYBOARD ENCLOSURE

[75] Inventor: Robert F. Crozier, Cornville, Ariz.

[73] Assignee: Hooleon Corporation, Cornville, Ariz.

[21] Appl. No.: 635,754

[22] Filed: Dec. 28, 1990

[51] Int. Cl.[5] ..... B65D 65/10

[52] U.S. Cl. ..... 150/154; 174/17.05; 200/302.2; 206/320; 206/524.8; 383/63; 383/103

[58] Field of Search ..... 206/524.8, 320, 497, 206/811; 383/3, 103, 63; 174/17.05; 200/302.2, 302.3; 180/154

[56] References Cited

U.S. PATENT DOCUMENTS

| | | | |
|---|---|---|---|
| 2,984,725 | 5/1961 | Hubbell et al. | 200/302.2 |
| 4,261,401 | 4/1981 | Hickey | 206/524.8 |
| 4,352,968 | 10/1982 | Pounds | 200/302.2 |
| 4,396,830 | 8/1983 | Isozaki et al. | 200/302.2 |
| 4,471,189 | 9/1984 | Bacon et al. | 200/302.2 |
| 4,555,600 | 11/1985 | Morse | 200/302.2 |
| 4,758,712 | 7/1988 | Matone, Jr. et al. | 200/302.2 |
| 4,768,230 | 8/1988 | Viebrantz et al. | 200/302.2 |
| 4,922,980 | 5/1990 | Parker | 206/320 |

FOREIGN PATENT DOCUMENTS

| | | | |
|---|---|---|---|
| 0871287 | 4/1942 | France | 200/302.2 |
| 2382759 | 9/1978 | France | 200/302.2 |
| 2165696 | 4/1986 | United Kingdom | 200/302.2 |

OTHER PUBLICATIONS

Wolfrom, Keyboard Contamination Shield, May, 1972 IBM Technical Disclosure Bulletin vol. 14, No. 12, p. 3633.

*Primary Examiner*—Stephen Marcus
*Assistant Examiner*—Christopher McDonald
*Attorney, Agent, or Firm*—Cahill, Sutton & Thomas

[57] ABSTRACT

A bag-like envelope is sized to receive a keyboard. The envelope has a reclosable and resealable opening for receiving the keyboard and another sealable opening for the electrical cable from the keyboard. A transparent panel of the envelope overlies the keys on one face of the keyboard. Air is evacuated from the interior of the envelope to cause the transparent panel to be drawn down onto the keys on the keyboard.

5 Claims, 1 Drawing Sheet

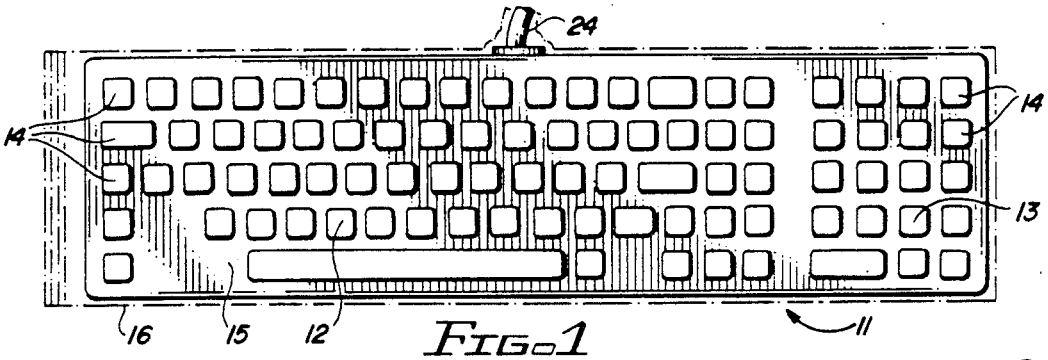
FIG. 1
FIG. 3
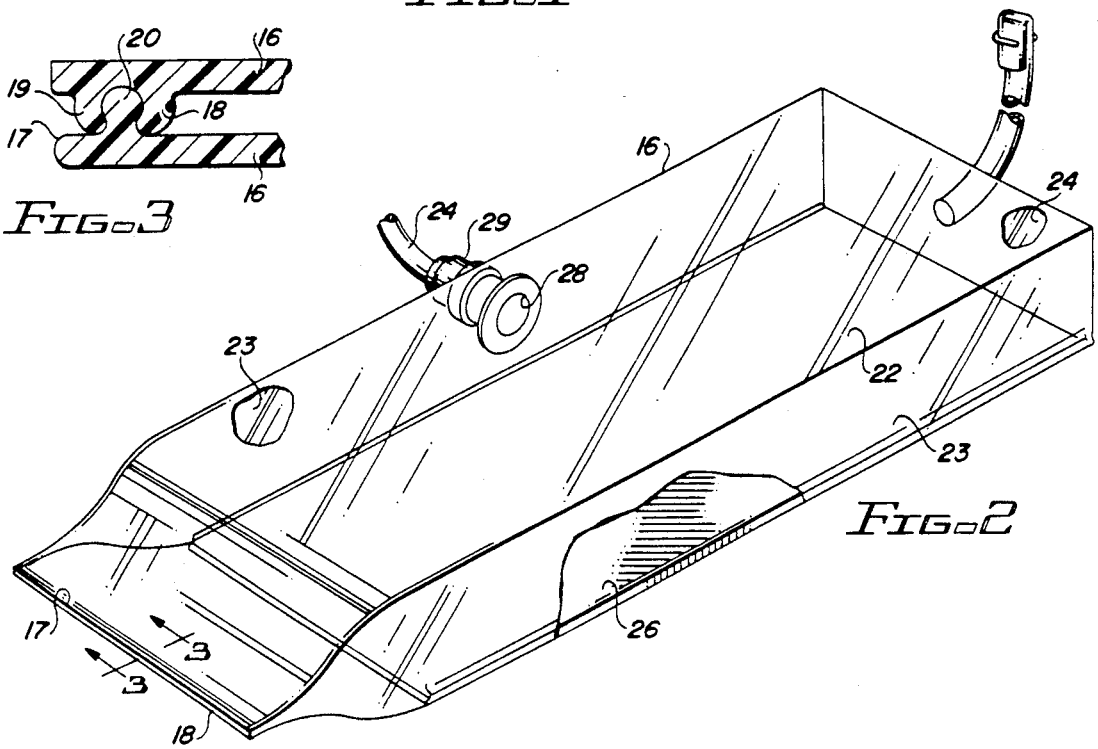
FIG. 2
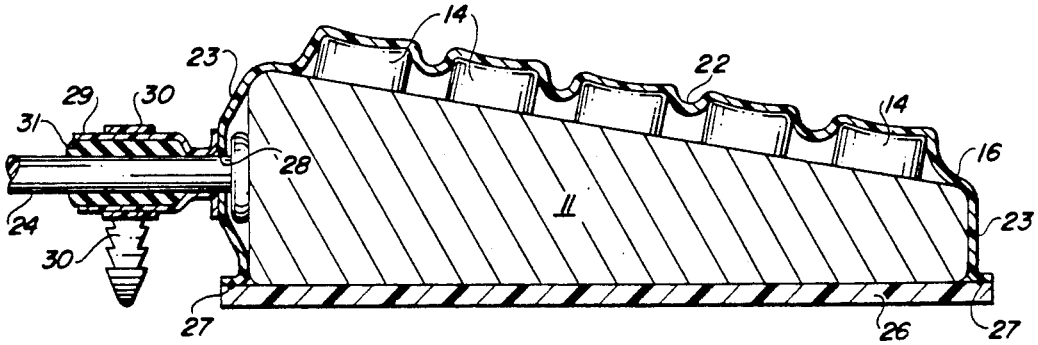
FIG. 4

KEYBOARD ENCLOSURE

TECHNICAL FIELD

This invention is concerned with environmentally protecting the keyboard of a computer or word processor.

BACKGROUND ART

Portable keyboards associated with computers and especially word processing equipment can be damaged by spilled liquids and dust and other harmful vapors in the air.

Some keyboard manufacturers make available vacuum formed sheet plastic covers which can be placed over the keyboards. Some of these covers are sufficiently flexible to permit the keyboard to be used with the cover in place; others must be removed before the keyboard can be used. Such covers do not provide a hermetically sealed environment for the keyboard and, of course, provide no protection at all when removed to permit use of the keyboard.

Furthermore, keyboards are produced in a variety (literally hundreds) of different configurations. Thus, an equal number of the vacuum formed covers would be required to provide protection for all the different keyboards which are available now or in the future. This greatly complicates the manufacture and distribution of keyboard covers.

DISCLOSURE OF THE INVENTION

This invention contemplates what might be termed a "generic", or fit all, keyboard cover capable of being used with many different keyboards. The cover comprises a bag-like enclosure, at least one panel of which is made of transparent, highly flexible, and somewhat elastic sheet plastic material. The enclosure includes sealable openings for (a) admitting the keyboard to the interior of the enclosure and (b) permitting egress of the keyboard electrical cable. The enclosure further includes means for evacuating air from the interior of the enclosure to cause the transparent panel thereof to be drawn down across and in contact with the keys in the keyboard. The transparent panel permits the keys to be viewed and manipulated through the panel while the keyboard is hermetically sealed within the enclosure.

BRIEF DESCRIPTION OF THE DRAWINGS

The invention is described in greater detail hereinafter by reference to the accompanying drawings, wherein:

FIG. 1 is a top view of a keyboard of the type to be protected by this invention;

FIG. 2 is a top perspective view of the keyboard enclosure of this invention;

FIG. 3 is an enlarged sectional view taken as indicated by line 3—3 in FIG. 2 and illustrating a closure employed in the invention; and FIG. 4 is an enlarged sectional view through the enclosure with the keyboard in place therein.

BEST MODE FOR CARRYING OUT THE INVENTION

Referring particularly to FIG. 1, there is illustrated a typical computer or word processor keyboard 11 having an alphanumeric keyboard 12 and a numeric key pad 13 thereon. The keyboard 11 comprises numerous keys 14 which are manipulated by the operator using his or her fingers to depress selected keys.

In order for the keys 14 to move freely, there must be some clearance between each key and the face plate 15 of the keyboard. And this clearance, although small, provides openings in the keyboard which can admit foreign matter to the interior of the keyboard. Such foreign matter, whether it be liquid, solid or gaseous, can be harmful to the delicate electrical circuitry within the interior of the keyboard.

Ideally, the keyboard 11 should be hermetically sealed against entrance of any foreign substances. And, the present invention makes that possible.

The principal component of the invention is a bag-like envelope 16 sized to receive and completely house the keyboard 11. Installation of the keyboard 11 into envelope 16 is through a reclosable opening 17 in one end of envelope 16. Opening 17 is sealed closed after insertion of the keyboard 11 by means of a continuous, linear releasable interlocking fastener 18. Fastener 18 is preferably formed of resilient plastic material and comprises a female track member 19 and a male track member 20. (See FIG. 3). Opening 17 in envelope 16 is opened by peeling apart fastener track members 19 and 20. Closure and sealing of opening 17 is accomplished by progressively pressing the female track member 19 onto the male track member 20.

At least the top panel, or wall, 22 of envelope 16 is preferably made of transparent material to permit the keys 14 on keyboard 11 to be viewed. This panel 22 might also be identified as the front panel of the envelope. The material from which panel 22 of envelope 16 is made is not only transparent, but it very thin so as to be highly supple, or flexible, and somewhat elastic. Thin film polyethylene plastic is suitable for this application.

For economy and ease of manufacture, the side panels 23 and the end panels 24 of envelope 16 may be made from the same material as the front panel 22. Indeed, these side panels may be made integral with, i.e. from the same sheet of material as, the front panel.

The back, or rear panel 26 of envelope 16 is also formed of sheet plastic material, but is preferably made of thicker, opaque material to readily distinguish it from the front panel 22. Edge regions of side and end panels 22 and 23 are preferably joined in sealing engagement with edge regions of back panel 26. If these panels are made from thermoplastic materials, the joinder can be accomplished by heat sealing, indicated at 27 in FIG. 4; otherwise an adhesive can be used to effect the joiner.

One of the side panels 23 of envelope 16 has an opening 28 permitting egress of an electrical cable 24 connecting keyboard 11 to the other components of the computer or word processing equipment, which are not shown. There preferably is a tubular nipple 29 sealed to panel 23 at opening 28 through which the cable passes (see FIG. 4). Nipple 29 is clasped about cable 24 by suitable means, such as a pull strap 30 and, if desired, a sealant 31, such as wax or silicone rubber, may be disposed between the nipple 29 and the cable 24 to insure an airtight closure on the cable.

It is desired that the top panel, or wall, 22 contact and closely conform to the configuration of the finger contact regions of all the keys 14 on the keyboard 11 (see FIG. 4). To insure this condition, means are provided in accordance with this invention to at least partially evacuate air from the interior of envelope 16. This may take the form of a suction tube 32 in communication with the interior of envelope 16. Air is drawn out of envelope 16, through the tube 32, by sucking on tube 32 or by using a suction device, such as a vacuum cleaner.

Once sufficient air has been evacuated from envelope 16 to draw top panel 22 of the envelope down against the keys, further evacuation is discontinued and the suction tube 32 sealed to hermetically seal the keyboard within the envelope 16. Sealing of tube 32 can be accomplished by any suitable means, such as plugging its end. However, it is preferred that tube 32 be made of a collapsible material, such as plastic or rubber, so that it may be closed by folding it back upon itself and clamping the folded end as indicated at 33 in FIG. 2. Of course, the evacuation tube 32 should possess sufficient rigidity to resist collapsing under air pressure when the partial vacuum is drawn in envelope 16.

With the transparent, thin, flexible, supple, and somewhat resilient top panel 22 of envelope 16 drawn closely against the finger contact surfaces of keys 14, the indicia thereon and the surface configurations of the keys can be easily discerned and the keys can be manipulated by the operator. All of this takes place with the keyboard 11 hermetically sealed within envelope 16 so that the keyboard is protected from all foreign substances.

It will be appreciated that so long as the envelope 16 is sized to receive the entire keyboard 11, the keyboard 11 is sealed in a useable condition regardless of the configuration of the keyboard, that is, regardless of the size,shape, number and placement of the keys 14. Thus, the protective enclosure of this invention may be used with a large variety of styles and types of keyboards.

What is claimed is:

1. An enclosure for a keyboard having a plurality of keys on one face thereof, comprising a bag-like envelope of a size to receive the entire keyboard, said envelope having a reclosable opening in one portion thereof for admitting the keyboard, said envelope having a sealable opening therein permitting egress of the electrical cable from said keyboard, said envelope having at least one panel thereof made from a thin, flexible, elastic and transparent plastic sheet, and means for evacuating air from the interior of said envelope to draw said panel of the envelope down over the keys on said one face of the keyboard.

2. The enclosure of claim 1, further characterized in that the means for evacuating air from the interior of said envelope is a flexible tube which can be collapsed by bending it back upon itself.

3. The enclosure of claim 2, further comprising a clamp for holding said tube in a collapsed condition.

4. The enclosure of claim 1, further characterized in that the sealable opening permitting egress of the electrical cable has a tubular nipple associated therewith which is adapted to be clamped in sealing engagement with said cable.

5. The enclosure of claim 1, further characterized in that the reclosable opening for admitting the keyboard is sealed by a continuous, linear, releasable, interlocking fastener.

* * * * *